US010741115B2

(12) United States Patent
Dai et al.

(10) Patent No.: US 10,741,115 B2
(45) Date of Patent: Aug. 11, 2020

(54) GATE DRIVING CIRCUIT

(71) Applicants: NANJING CEC PANDA FPD TECHNOLOGY CO., LTD., Nanjing, Jiangsu Province (CN); NANJING HUADONG ELECTRONICS INFORMATION & TECHNOLOGY CO., LTD., Nanjing, Jiangsu Province (CN)

(72) Inventors: Chao Dai, Nanjing (CN); Zhijun Wang, Nanjing (CN)

(73) Assignees: NANJING CEC PANDA FPD TECHNOLOGY CO., LTD., Nanjing, Jiangsu Province (CN); NANJING HUADONG ELECTRONICS INFORMATION & TECHNOLOGY CO., LTD., Nanjing, Jiangsu Province (CN)

( * ) Notice: Subject to any disclaimer, the term of this patent is extended or adjusted under 35 U.S.C. 154(b) by 78 days.

(21) Appl. No.: 16/313,151

(22) PCT Filed: Sep. 14, 2017

(86) PCT No.: PCT/CN2017/101712

§ 371 (c)(1),
(2) Date: Dec. 25, 2018

(87) PCT Pub. No.: WO2018/054260

PCT Pub. Date: Mar. 29, 2018

(65) Prior Publication Data

US 2019/0156723 A1 May 23, 2019

(30) Foreign Application Priority Data

Sep. 23, 2016 (CN) ..... 2016 1 0845841

(51) Int. Cl.
*G09G 3/20* (2006.01)
*G09G 3/36* (2006.01)

(52) U.S. Cl.
CPC ..... *G09G 3/20* (2013.01); *G09G 3/3677* (2013.01); *G09G 2300/0426* (2013.01);
(Continued)

(58) Field of Classification Search
CPC . G09G 3/20; G09G 3/3677; G09G 2310/0286
See application file for complete search history.

(56) References Cited

U.S. PATENT DOCUMENTS

2012/0082287 A1 4/2012 Moriwaki

FOREIGN PATENT DOCUMENTS

CN 101079243 A 11/2007
CN 102542278 A 7/2012
(Continued)

*Primary Examiner* — Kent W Chang
*Assistant Examiner* — Chayce R Bibbee
(74) *Attorney, Agent, or Firm* — Cheng-Ju Chiang

(57) ABSTRACT

A gate driving circuit includes a first switch element, a second switch element, a third switch element, a fourth switch element, a fifth switch element, and a sixth switch element. Wherein, the third switch element receives a reference low level voltage to stabilize the voltage of a pull-up control node. A stabilization module consisting of the fourth switch element, the fifth switch element and the sixth switch element is configured to stabilize the voltage of a gate drive signal outputted by a fourth conductive terminal of the second switch element during a non-scanning period.

13 Claims, 8 Drawing Sheets

(52) U.S. Cl.
CPC ..... *G09G 2300/0809* (2013.01); *G09G 2310/0286* (2013.01); *G09G 2310/08* (2013.01)

(56) References Cited

FOREIGN PATENT DOCUMENTS

| | | | |
|---|---|---|---|
| CN | 102842278 | A | 12/2012 |
| CN | 103262148 | A | 8/2013 |
| CN | 104282255 | A | 1/2015 |
| CN | 104732904 | A | 6/2015 |
| CN | 104851403 | A | 8/2015 |
| CN | 105206243 | A | 12/2015 |
| CN | 105280153 | A | 1/2016 |
| CN | 106228942 | A | 12/2016 |

GATE DRIVING CIRCUIT

CROSS REFERENCE TO RELATED APPLICATION

The present application is a 35 U.S.C. § 371 National Phase conversion of International (PCT) Patent Application No. PCT/CN2017/101712, filed on Sep. 14, 2017, which is based on and claims priority of Chinese Application No. 201610845841.1, filed on Sep. 23, 2016. The entire disclosure of the above-identified application is incorporated herein by reference in its entirety. The PCT International Patent Application was filed and published in Chinese.

FIELD OF THE INVENTION

The present disclosure relates to display technology, and more particularly to a gate driving circuit.

BACKGROUND OF THE INVENTION

Currently, in order to increase the proportion of screen, narrow bezel and even bezel-free design has become development trend of electronic devices such as mobile phones.

FIG. 1 shows a structure diagram of an existing display panel. As shown in FIG. 1, a gate driving circuit on both sides of a liquid crystal display panel (Gate driving Monolithic, GDM) is integrated on the liquid crystal display panel directly through integration technology. As shown in FIG. 2, the gate driving circuit generally adopts staggered design of single-side drive. One side of gate driving circuit is responsible for driving the odd-row pixel unit, while the other side of gate driving circuit is responsible for driving the even row pixel unit. Wherein structure of the gate driving circuit determines the width of the left bezel and right bezel of the LCD panel directly.

As shown in FIG. 3, an existing gate driving circuit adopts the design scheme of 13T1C, that is, the existing gate driving circuit is consisting of 13 number of thin film transistors (TFT) and 1 number of bootstrap capacitor, which adopts more thin-film transistors.

Technical Problems

The existing gate driving circuit is not conducive to realization of the narrow bezel design, and power consumption is high. In addition, gate driving signal outputted by the existing gate driving circuit cannot maintain low level all the time during the non-scanning period, and reliability is poor.

SUMMARY OF THE INVENTION

Technical Solution

The present disclosure provides a gate driving circuit with fewer number of thin film transistors and high reliability.

For the purpose of the present disclosure, the technical scheme adopted by the present disclosure is: a gate driving circuit configured to output a n-th gate driving signal, wherein n is a positive integer, and the gate driving circuit includes a first switch element, a second switch element, a third switch element, a fourth switch element, a fifth switch element and a sixth switch element. A first conductive terminal of the first switch element receives a first start signal, a first control terminal of the first switch element receives a first clock signal. A third conductive terminal of the second switch element receives a second clock signal, a second control terminal of the second switch element is connected to a second conductive terminal of the first switch element and connected to a fourth conductive terminal of the second switch through a first capacitor. A fifth conductive terminal of the third switch element is connected to the second conductive terminal of the first switch element, a third control terminal of the third switch element receives a first pull-down signal, a sixth conductive terminal of the third switch element receives reference low level voltage. A seventh conductive terminal of the fourth switch element receives reference high level voltage and is connected to a fourth control terminal of the fourth switch element. A ninth conductive terminal of the fifth switch element is connected to an eighth conductive terminal of the fourth switch element, a fifth control terminal of the fifth switch element is connected to the second conductive terminal of the first switch element, a tenth conductive terminal of the fifth switch element receives the reference low level voltage. An eleventh conductive terminal of the sixth switch element is connected to the fourth conductive terminal of the second switch element, a sixth control terminal of the sixth switch element is connected to the eighth conductive terminal of the fourth switch element, a twelfth conductive terminal of the sixth switch element receives the reference low level voltage.

In one embodiment, the first start signal is an (n−2)-th gate driving signal outputted by an (n−2)-th stage of gate driving circuit, the first pull-down signal is a first pulse signal when $n \geq 3$; the first start signal is the first pulse signal, and the first pull-down signal is the reference low level voltage when $n<3$.

In one embodiment, the gate driving circuit further includes a seventh switch element, a thirteenth conductive terminal of the seventh switch element is connected to the fourth conductive terminal of the second switch element, a seventh control terminal of the seventh switch element receives a clear-reset signal, and a fourteenth conductive terminal of the seventh switch element receives the reference low level voltage.

In one embodiment, the gate driving circuit further includes an eighth switch element, a fifteenth conductive terminal of the eighth switch element is connected to the second control terminal of the second switch element, an eighth control terminal of the eighth switch element receives a clear-reset signal, and a sixteenth conductive terminal of the eighth switch element receives the reference low level voltage.

In one embodiment, the gate driving circuit further includes a twelfth switch element, a twenty-third conductive terminal of the twelfth switch element is connected to the eighth conductive terminal of the fourth switch element, and a twelfth control terminal of the twelfth switch element receives the first start signal, and a twenty-fourth conductive terminal of the twelfth switch element receives the reference low level voltage.

The present disclosure also provides a gate driving circuit configured to output a n-th gate driving signal, wherein $n \leq N$, n and N are positive integers, and the gate driving circuit includes a first switch element, a second switch element, a third switch element, a fourth switch element, a fifth switch element, a sixth switch element and a ninth switch element. A first conductive terminal of the first switch element receives a second start signal, a first control terminal of the first switch element is connected to the first conductive terminal of the first switch element. A third conductive terminal of the second switch element receives a third clock signal, a second control terminal of the second switch element is connected to a second conductive terminal of the first switch element and connected to a fourth conductive terminal of the second switch through a first capacitor. A fifth conductive terminal of the third switch element is connected to the second conductive terminal of the first switch element, a third control terminal of the third switch element receives a second pull-down signal, a sixth conductive terminal of the third switch element receives reference low level voltage. A seventh conductive terminal of the fourth switch element receives reference high level voltage and is connected to a fourth control terminal of the fourth switch element. A ninth conductive terminal of the fifth switch element is connected to an eighth conductive terminal of the fourth switch element, a fifth control terminal of the fifth switch element is connected to the second conductive terminal of the first switch element, a tenth conductive terminal of the fifth switch element receives the reference low level voltage. An eleventh conductive terminal of the sixth switch element is connected to the fourth conductive terminal of the second switch element, a sixth control terminal of the sixth switch element is connected to the eighth conductive terminal of the fourth switch element, a twelfth conductive terminal of the sixth switch element receives the reference low level voltage. A seventeenth conductive terminal of the ninth switch element is connected to the second conductive terminal of the first switch element, a ninth control terminal of the ninth switch element receives a third clock signal, the eighteenth terminal of the ninth switch element is connected to an eleventh conductive terminal of the sixth switch element.

In one embodiment, the gate driving circuit further includes a seventh switch element, a thirteenth conductive terminal of the seventh switch element is connected to the fourth conductive terminal of the second switch element, a seventh control terminal of the seventh switch element receives a clear-reset signal, and a fourteenth conductive terminal of the seventh switch element receives the reference low level voltage.

In one embodiment, the gate driving circuit further includes an eighth switch element, a fifteenth conductive terminal of the eighth switch element is connected to the second control terminal of the second switch element, an eighth control terminal of the eighth switch element receives a clear-reset signal, and a sixteenth conductive terminal of the eighth switch element receives the reference low level voltage.

In one embodiment, the gate driving circuit further includes a tenth switch element, a nineteenth conductive terminal of the tenth switch element is connected to eighteenth conductive terminal of the ninth switch element, a tenth control terminal of the tenth switch element is connected to the eighth conductive terminal of the fourth element, the twentieth conductive terminal of the tenth switch element is connected to the fourth conductive terminal of the second switch element.

In one embodiment, the gate driving circuit further includes a twelfth switch element, a twenty-third conductive terminal of the twelfth switch element is connected to the eighth conductive terminal of the fourth switch element, and a twelfth control terminal of the twelfth switch element receives the second start signal, and a twenty-fourth conductive terminal of the twelfth switch element receives the reference low level voltage.

In one embodiment, wherein the second start signal is an (n−4)-th gate driving signal outputted by an (n−4)-th stage of gate driving circuit when n>4, the second pull-down signal is an (n+6)-th gate driving signal outputted by an (n+6)-th stage of gate driving circuit when n≤N−6.

The present disclosure also provides a gate driving circuit configured to output a n-th gate driving signal, wherein n≤N, n and N are positive integers, and the gate driving circuit includes a first switch element, a second switch element, a third switch element, a fourth switch element, a fifth switch element, a sixth switch element, a ninth switch element and an eleventh switch element. A first conductive terminal of the first switch element receives a second start signal, a first control terminal of the first switch element is connected to the first conductive terminal of the first switch element. A third conductive terminal of the second switch element receives a third clock signal, a second control terminal of the second switch element is connected to a second conductive terminal of the first switch element and is connected to a fourth conductive terminal of the second switch through a first capacitor. A fifth conductive terminal of the third switch element is connected to the second conductive terminal of the first switch element, a third control terminal of the third switch element receives a second pull-down signal, a sixth conductive terminal of the third switch element receives reference low level voltage. A seventh conductive terminal of the fourth switch element receives reference high level voltage and is connected to a fourth control terminal of the fourth switch element. A ninth conductive terminal of the fifth switch element is connected to an eighth conductive terminal of the fourth switch element, a fifth control terminal of the fifth switch element is connected to the second conductive terminal of the first switch element, a tenth conductive terminal of the fifth switch element receives the reference low level voltage. An eleventh conductive terminal of the sixth switch element is connected to the fourth conductive terminal of the second switch element, a sixth control terminal of the sixth switch element is connected to the eighth conductive terminal of the fourth switch element, a twelfth conductive terminal of the sixth switch element receives the reference low level voltage. A seventeenth conductive terminal of the ninth switch element is connected to the second conductive terminal of the first switch element, a ninth control terminal of the ninth switch element receives a third clock signal. A twenty-first conductive terminal of the eleventh switch element is connected to an eighteenth conductive terminal of the ninth switch element, an eleventh control terminal of the eleventh switch element is connected to the eighth conductive terminal of the fourth switch element, a twenty-second conductive terminal of the eleventh switch element receives the reference low level voltage.

The present disclosure also provides a gate driving circuit configured to output a n-th gate driving signal, wherein n≤N, n and N are positive integers, and the gate driving circuit includes a first switch element, a second switch element, a third switch element, a fourth switch element, a fifth switch element, a sixth switch element, a thirteenth switch element. A first conductive terminal of the first switch element receives a second start signal, a first control terminal of the first switch element is connected to the first conductive terminal of the first switch element. A third conductive terminal of the second switch element receives a third clock signal, a second control terminal of the second switch element is connected to a second conductive terminal of the first switch element and is connected to a fourth conductive terminal of the second switch through a first capacitor. A fifth conductive terminal of the third switch element is connected to the second conductive terminal of the first switch element, a third control terminal of the third switch element receives a second pull-down signal, a sixth conductive terminal of the third switch element receives reference low level voltage. A seventh conductive terminal of the fourth switch element receives reference high level voltage and is connected to a fourth control terminal of the fourth switch element. A ninth conductive terminal of the fifth switch element is connected to an eighth conductive terminal of the fourth switch element, a fifth control terminal of the fifth switch element is connected to the second conductive terminal of the first switch element, a tenth conductive terminal of the fifth switch element receives the reference low level voltage. An eleventh conductive terminal of the sixth switch element is connected to the fourth conductive terminal of the second switch element, a sixth control terminal of the sixth switch element is connected to the eighth conductive terminal of the fourth switch element, a twelfth conductive terminal of the sixth switch element receives the reference low level voltage. A twenty-fifth conductive terminal of the thirteenth switch element is connected to a second conductive terminal of the first switch element, and a thirteenth control terminal of the thirteenth switch element is connected to the eighth conductive terminal of the fourth switch element, and a twenty-sixth conductive terminal of the thirteenth switch element receives the reference low level voltage.

In one embodiment, the gate driving circuit further includes a seventh switch element, a thirteenth conductive terminal of the seventh switch element is connected to the fourth conductive terminal of the second switch element, a seventh control terminal of the seventh switch element receives a clear-reset signal, and a fourteenth conductive terminal of the seventh switch element receives the reference low level voltage.

In one embodiment, the gate driving circuit further includes an eighth switch element, a fifteenth conductive terminal of the eighth switch element is connected to the second control terminal of the second switch element, an eighth control terminal of the eighth switch element receives a clear-reset signal, and a sixteenth conductive terminal of the eighth switch element receives the reference low level voltage.

In one embodiment, the gate driving circuit further includes a twelfth switch element, a twenty-third conductive terminal of the twelfth switch element is connected to the eighth conductive terminal of the fourth switch element, and a twelfth control terminal of the twelfth switch element receives the second start signal, and a twenty-fourth conductive terminal of the twelfth switch element receives the reference low level voltage.

In one embodiment, the second start signal is an (n−4)-th gate driving signal outputted by an (n−4)-th stage of gate driving circuit when n>4, the second pull-down signal is an (n+6)-th gate driving signal outputted by an (n+6)-th stage of gate driving circuit when n≤N−6.

Beneficial Effects

The third switch element of the gate driving circuit of the present disclosure receives the reference low level voltage to stabilize the voltage of a pull-up control node, a stabilization module consisting of the fourth switch element, the fifth switch element and the sixth switch element is configured to stabilize the voltage of a gate driving signal during a non-scanning period The present disclosure makes it possible to achieve a simpler design, a narrower border in the display, and a gate driving circuit with greater stability.

DETAILED DESCRIPTION OF PREFERRED EMBODIMENTS

To make the objective, the technical solutions and advantages of the present disclosure more clear and understandable, embodiments of the present disclosure will be described in detail accompanying with FIGS. as follows.

The disclosure is illustrated below with an example of any stage of gate driving circuit in odd-line.

A First Embodiment

Figure 1:
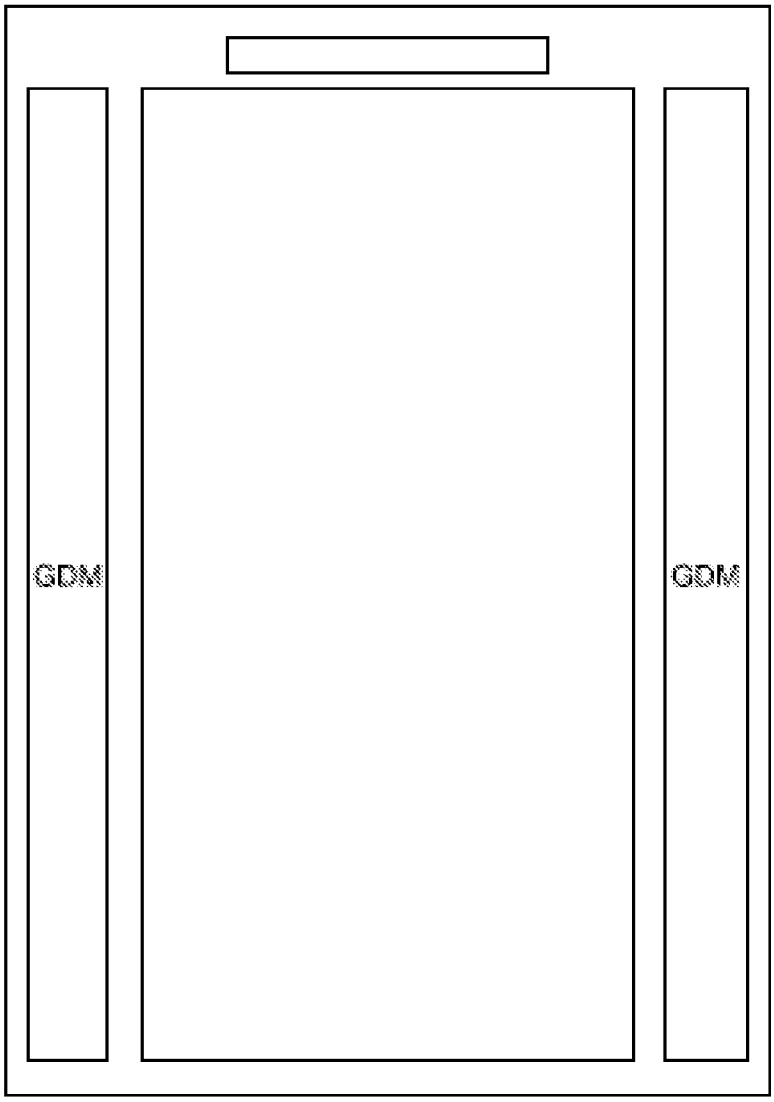
FIG. 1 (Prior Art)
FIG. 1 is a basic structure diagram of a display panel of an embodiment.
Figure 2:
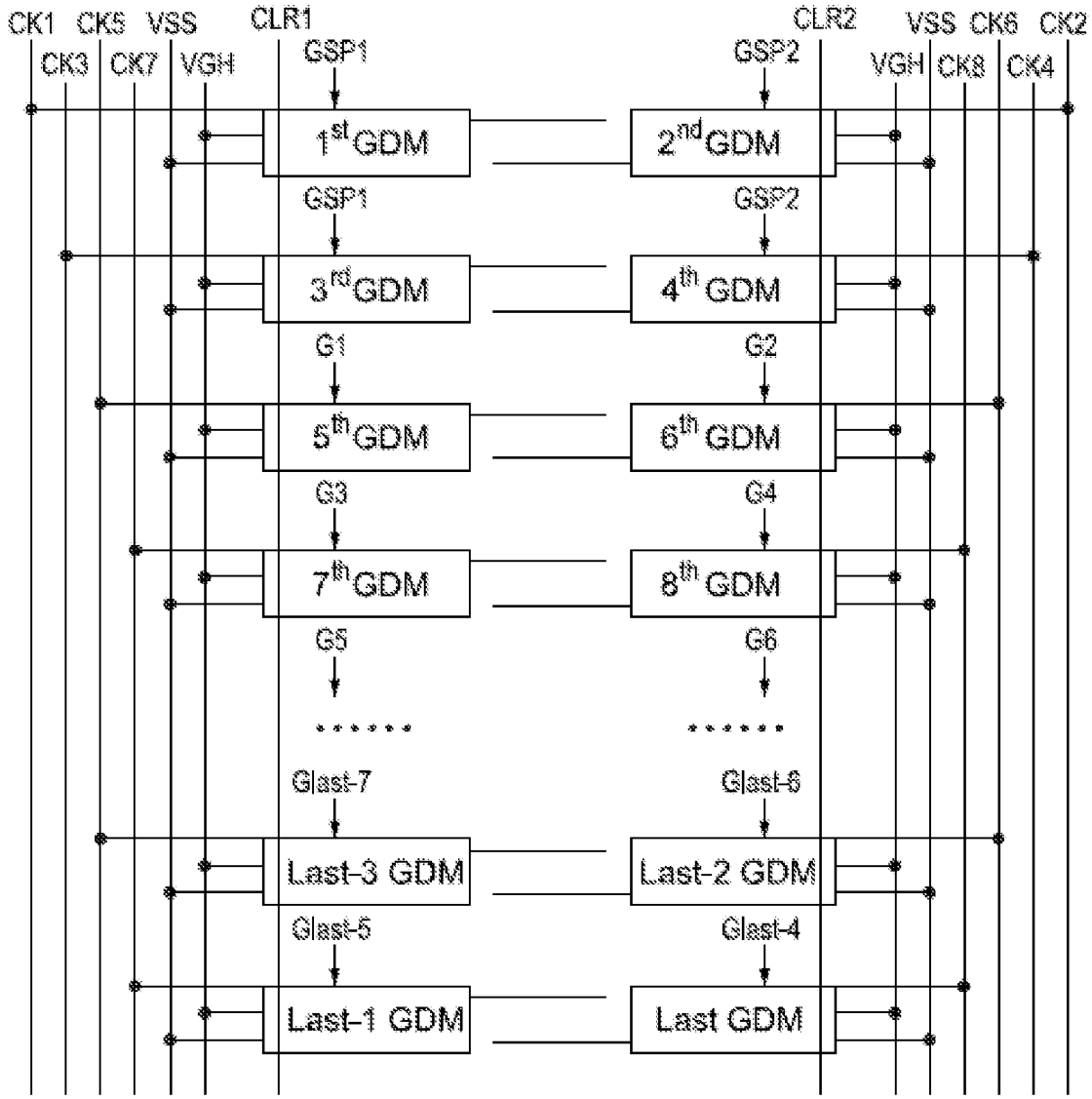
FIG. 2 (Prior Art)
FIG. 2 is a schematic diagram of the staggered design of a gate driving circuit of an embodiment.
Figure 3:
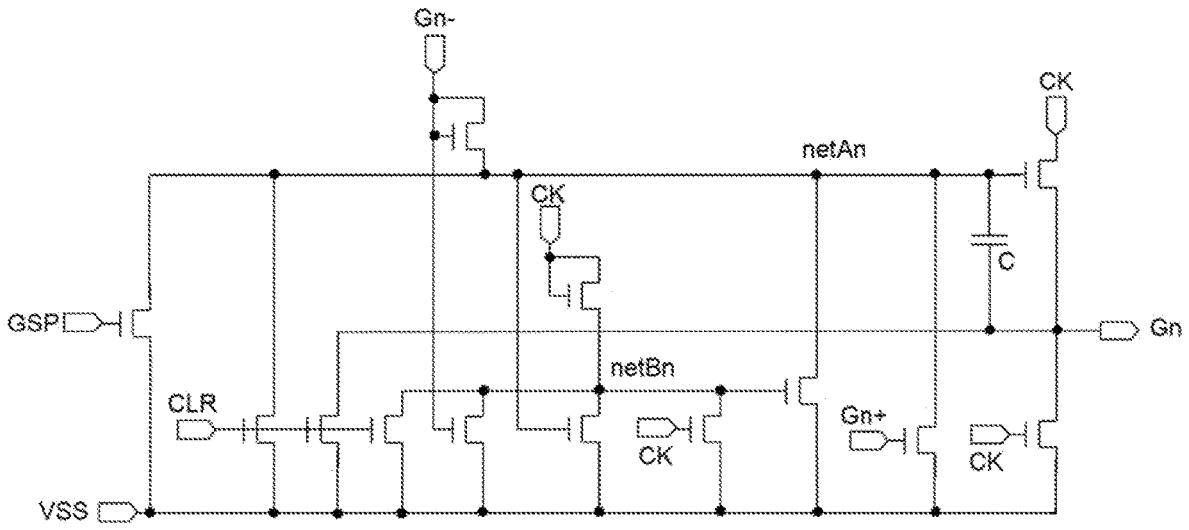
FIG. 3 (Prior Art)
FIG. 3 is a circuit diagram of an existing gate driving circuit.
Figure 4:
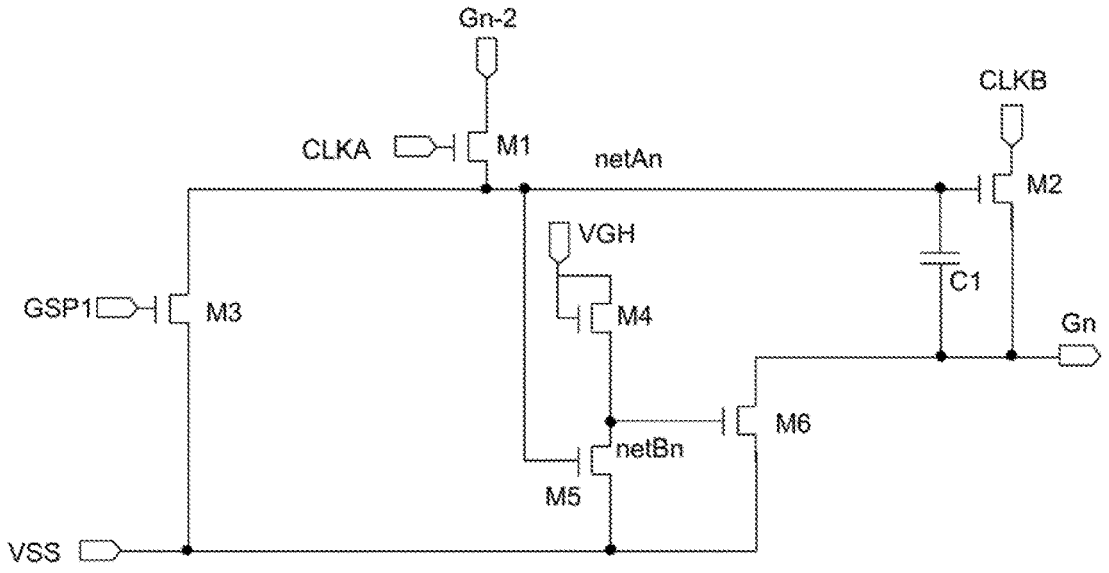
FIG. 4 is a schematic diagram of a gate driving circuit including 6T1C of a first embodiment of the present disclosure.

FIG. 4 is a schematic diagram of a gate driving circuit including 6T1C of the first embodiment of the present disclosure. As shown in FIG. 4, the gate driving circuit is configured to output a n-th gate driving signal Gn, wherein n is a positive integer. The gate driving circuit includes a precharge module, a driving module, a pull-down module and a stabilization module.

In an embodiment of the present disclosure, the precharge module includes a first switch element M1, the first switch element M1 is configured to precharge a pull-up control node netAn, and maintain potential of the pull-up control node netAn at high level. The driving module includes a second switch element M2, the second switch element M2 is configured to drive the n-th gate driving signal outputted by an n-th stage of gate driving circuit. The pull-down module includes a third switch element M3 is configured to maintain potential of the pull-up control node netAn at low level at a start of each frame. The stabilization module includes the fourth switch element M4, the fifth switch element M5 and the sixth switch element M6, the stabilization module is configured to maintain potential of the gate driving signal Gn at low level during the stabilization stage.

Specifically, a first conductive terminal of the first switch element M1 receives a first start signal, and a first control terminal of the first switch element M1 receives a first clock signal CLKA. A third conductive terminal of the second switch element M2 receives a second clock signal CLKB, and a second control terminal of the second switch element M2 is connected to a second conductive terminal of the first switch element M1 to form the pull-up control node netAn. The second control terminal of the second switch element M2 is connected to a fourth conductive terminal of the second switch element M2 through a first capacitor C1. A fifth conductive terminal of the third switch M3 is connected to the second conductive terminal of the first switch M1, a third control terminal of the third switch M3 receives a first pull-down signal, and a sixth conductive terminal of the third switch M3 receives a reference low level voltage VSS. A seventh conductive terminal of the fourth switch element M4 receives a reference high level voltage VGH and is connected to a fourth control terminal of the fourth switch element M4. A ninth conductive terminal of the fifth switch element M5 is connected to an eighth conductive terminal of the fourth switch element M4 to form a maintenance node netBn, a fifth control terminal of the fifth switch element M5 is connected to the second conductive terminal of the first switch element M1, and a tenth conductive terminal of the fifth switch element M5 receives the reference low level voltage VSS. An eleventh conductive terminal of the sixth switch element M6 is connected to the fourth conductive terminal of the second switch element M2, a sixth control terminal of the sixth switch element M6 is connected to the eighth conductive terminal of the fourth switch element M4, and a twelfth conductive terminal of the sixth switch element M6 receives the reference low level voltage VSS.

In the embodiment of the present disclosure, the first start signal is a (n−2)-th gate driving signal Gn−2 outputted by a (n−2)-th stage of gate driving circuit, the first pull-down signal is a first pulse signal GPS1 when n≥3. The first start signal is the first pulse signal GPS1, and the first pull-down signal is the reference low level voltage VSS when n<3.

A Second Embodiment

Figure 5:
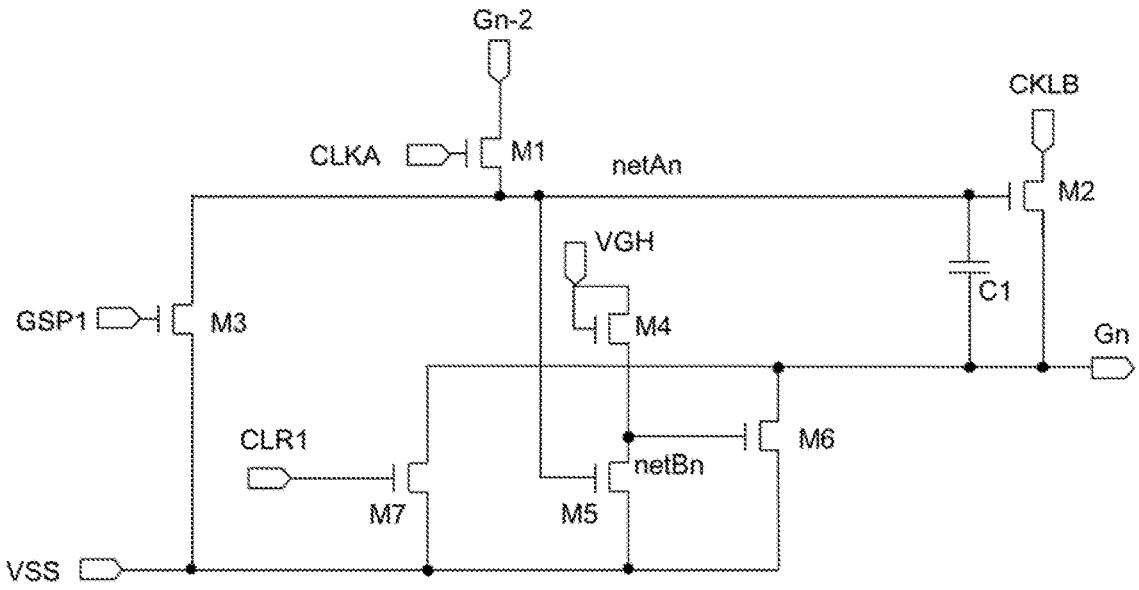
FIG. 5 is a schematic diagram of a gate driving circuit including 7T1C of a second embodiment of the present disclosure.

FIG. 5 is a schematic diagram of a gate driving circuit including 7T1C of a second embodiment of the present disclosure. Structure of the gate driving circuit shown in FIG. 5 is basically the same as structure of the gate driving circuit shown in FIG. 4, except that the gate driving circuit shown in FIG. 5 also includes a clear-reset module. In this embodiment, the clear-reset module includes a seventh switch element M7.

In one embodiment of the present disclosure, a thirteenth conductive terminal of the seventh switch element M7 is connected to the fourth conductive terminal of the second switch element M2, a seventh control terminal of the seventh switch element M7 receives a clear-reset signal CLR1, and a fourteenth conductive terminal of the seventh switch element M7 receives the reference low level voltage VSS.

In one embodiment of the present disclosure, the clear-reset signal CLR1 outputs a pulse signal with high level at an end of each frame, so when the seventh control terminal of the seventh switch element M7 receives the pulse signal with high level, the thirteenth conductive terminal of the seventh switch element M7 is connected to the fourteenth conductive terminal, and the gate driving signal Gn can maintain at low level through the seventh switch element M7 which is in turn on state.

A Third Embodiment

Figure 6:
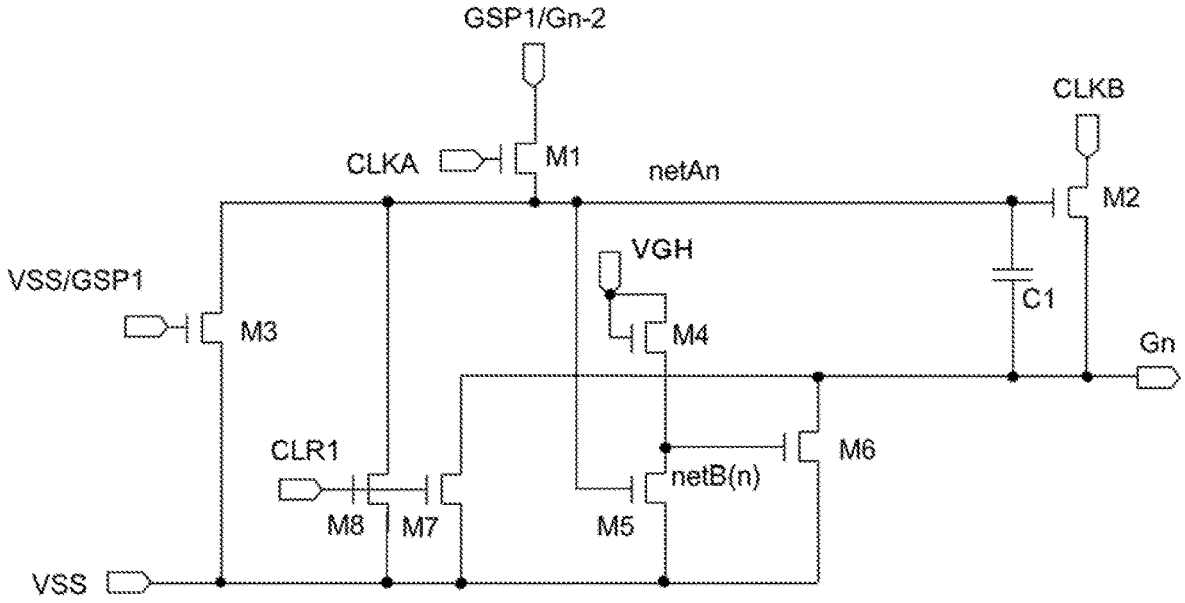
FIG. 6 is a schematic diagram of a gate driving circuit including 8T1C of a third embodiment of the present disclosure.

FIG. 6 is a schematic diagram of a gate driving circuit including 8T1C of a second embodiment of the present disclosure. Structure of the gate driving circuit shown in FIG. 6 is basically the same as structure of the gate driving circuit shown in FIG. 5, except that the clear-reset module shown in FIG. 6 also includes an eighth switch element M8.

In this embodiment, a fifteenth conductive terminal of the eighth switch element M8 is connected to the second control terminal of the second switch element M2, an eighth control terminal of the eighth switch element M8 is connected to the seventh control terminal of the seventh switch element M7, and a sixteenth conductive terminal of the eighth switch element M8 receives the reference low level voltage VSS.

In this embodiment, the first switch element Ml, the second switch element M2, the third switch element M3, the fourth switch element M4, the fifth switch element M5, the sixth switch element M6, the seventh switch element M7 and the eighth switch element M8 are all n-type metal-oxide-semiconductors. The first control terminal to the eighth control terminal are all gates. The first conductive terminal of the first switch element of Ml, the third conductive terminal of the second switch element M2, the fifth conductive terminal of the third switch element M3, the seventh conductive terminal of the fourth switch element M4, the ninth conductive terminal of the fifth switch element M5, the eleventh conductive terminal of the sixth switch element M6, the thirteenth conductive terminal of the seventh switch element M7, the fifteenth conductive terminal of the eighth switch element M8 are all drains. The second conductive terminal of the first switch element of Ml, the fourth conductive terminal of the second switch element M2, the sixth conductive terminal of the third switch element M3, the eighth conductive terminal of the fourth switch element M4, the tenth conductive terminal of the fifth switch element M5, the twelfth conductive terminal of the sixth switch element M6, the fourteenth conductive terminal of the seventh switch element M7, the sixteenth conductive terminal of the eighth switch element M8 are all sources.

In other ways, the first switch element M1, the second switch element M2, the third switch element M3, the fourth switch element M4, the fifth switch element M5 and the sixth switch element M6 and the seventh switch element M7, the eighth switch element M8 can also be other switch element, such as p-type metal-oxide-semiconductor and so on.

Figure 7:
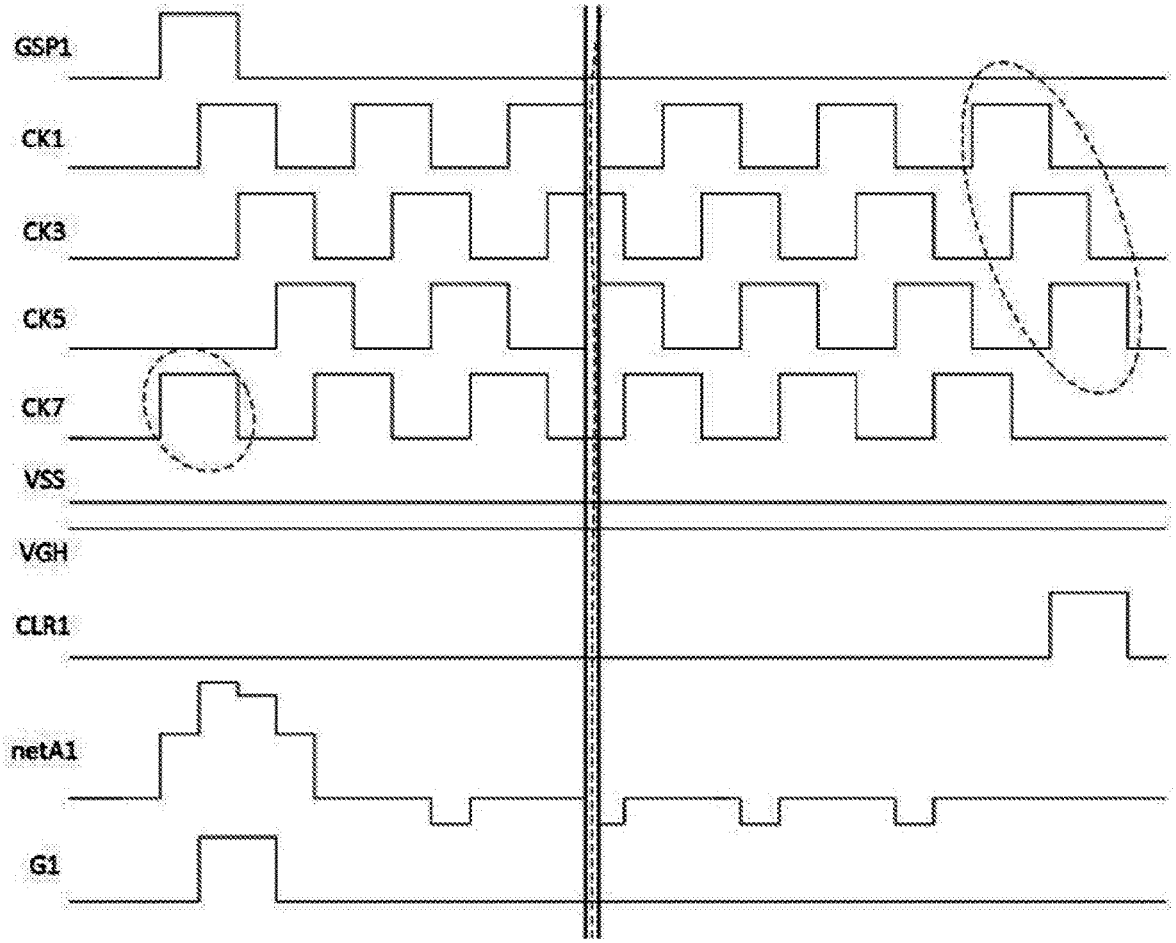
FIG. 7 shows the waveform of a first stage of gate driving circuit as shown in FIG. 6.

Please refer to FIG. 7, the first clock signal CLKA and the second clock signal CLKB of this embodiment can be provided by two of a first timing signal CK1, a second timing signal CK3, a third timing signal CK5 and a fourth timing signal CK7 shown in FIG. 7. The duty ratio of the first timing signal CK1, the second timing signal CK3, the third timing signal CK5 and the fourth timing signal CK7 are all 50%.

Please refer to FIG. 6 and FIG. 7 at the same time, the following takes an example to concretely introduce the working principle of the embodiment, wherein, the first switch element M1 to the eighth switch element M8 are n-type metal-oxide-semiconductors, the gate driving circuit is configured to output the first gate driving signal, the first clock signal CLKA is the fourth timing signal CK7, the second clock signal CLKB is the first timing signal.

Since the time when the fourth timing signal CK7 is at a high voltage level is later than the time when the first timing signal CK1 is at a high voltage level, the first timing signal CK1 needs to add a dummy-space-instruction cycle at an end of a period, and the fourth timing signal CK7 needs to add a dummy-space-instruction cycle at a front of the period.

The working process of the gate driving circuit can be divided into four stages: a precharge stage, a pull-up stage, a pull-down stage and a stabilization stage:

The precharge stage: the first pulse signal GSP1 and the first clock signal CLKA (i.e. the fourth timing signal CK7) change from low level to high level, and the pull-up control node netAn is pre-charged. In addition, because the pull-up control node netAn is pre-charged and the fifth switch element M5 is turned on, voltage of the maintenance node netBn is pulled down to the reference low level voltage VSS through the fifth switch element M5 which is turned on.

The pull-up stage: when level of the second clock signal CLKB (i.e. the first timing signal CK1) changes from low to high, the second switch element M2 turns on because the pull-up control node netAn has been pre-charged in the pre-charging stage. Due to turn-on of the second switch element M2 and bootstrapping effect of the first capacitor Cl, the voltage of the pull-up control node netAn is further increased. As the voltage of the pull-up control node netAn is further increased, the second switch element M2 is more fully turned on, thus the gate driving signal Gn at an output terminal of the first stage of gate driving circuit is raised.

In the present disclosure, a parasitic capacitor between the fourth conductive terminal and the second control terminal of the second switch element M2 can be directly used as the first capacitor C1, or an independent storage capacitor can be set between the second control terminal and the fourth conductive terminal of the second switch element M2 in order to improve pull-up effect, wherein, the independent storage capacitor is parallel to the parasitic capacitor of the second switch element M2 to act as the first capacitor C1.

The pull-down stage: when the level of the second clock signal CLKB (i.e. the first timing signal CK1) changes from high to low, the level of the gate driving signal Gn is further pulled down by the second clock signal CLKB through the second switch element M2 which is turned on, and the pull-up control node netAn is also pulled down by the bootstrapping effect of the first capacitor C1. Then the level of the first clock signal CLKA changes from low to high, the first switch element M1 is turned on, and the voltage of the pull-up control node netAn is pulled down again through the first switch element M1 which is turned on.

The stabilization stage: in the pull-down stage, the gate driving signal Gn outputted by the gate driving circuit is pulled down through the second switch element M2 which is turned on, and the voltage of the pull-up control node netAn is pulled down through the first switch element M1 which is turned on. Therefore, in the subsequent period, i.e. the stabilization stage, the stabilization module is needed to maintain the pull-up control node, the gate driving signal Gn which is outputted by the gate driving circuit at low level, so as to obtain ideal waveform.

Specifically, in the subsequent period, the fourth switch element M4 is turned on, and the maintenance node is pulled up to high level by the reference high level voltage VGH through the fourth switch element M4 which is turned on. Therefore, the sixth switch element M6 is turned on, so that the gate driving signal Gn is maintained at a low level through the sixth switch element M6 which is turned on.

In addition, the clear-reset signal CLR1 outputs a pulse signal with high level at the end of each frame, so that when the eighth control terminal of the eighth switch element M8 receives the pulse signal with high level, the fifteenth conductive terminal of the eighth switch element M8 is connected to the sixteenth conductive terminal of the eighth switch element M8, and the level of the pull-up control node netAn can be pulled down through the eighth switch element M8 which is turned on, that is to say, charge of the pull-up control node netAn can be cleared, thus further avoiding an impact of residual charge on the driving method of next frame.

A Fourth Embodiment

Figure 8:
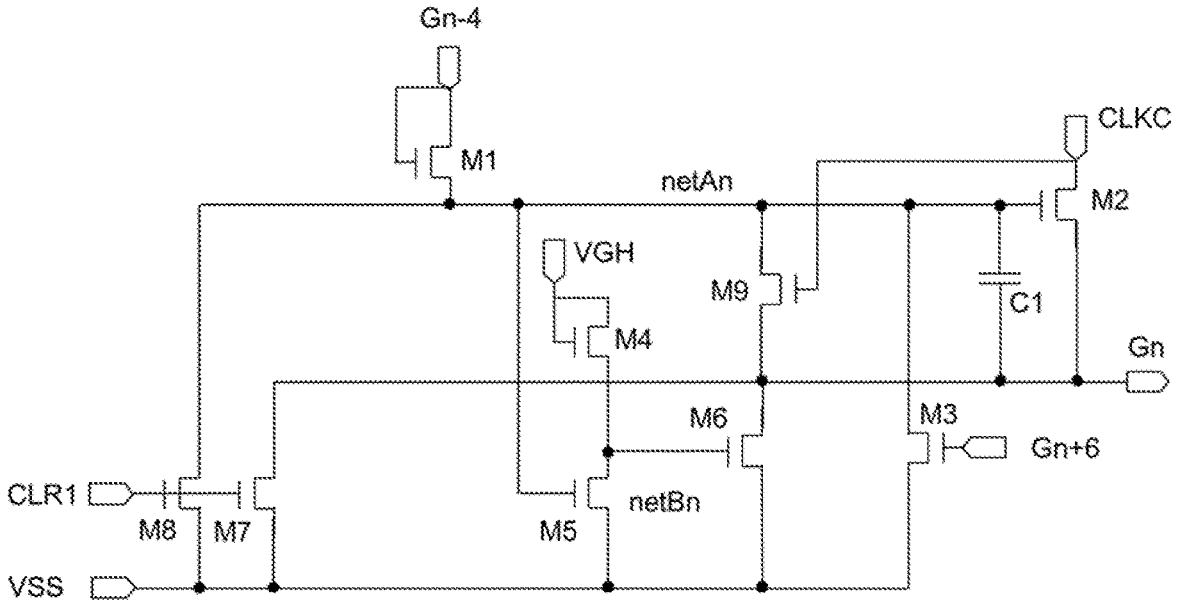
FIG. 8 is a schematic diagram of a gate driving circuit including 9T1C of a fourth embodiment of the present disclosure.

FIG. 8 is a schematic diagram of the gate driving circuit including the 9T1C of the fourth embodiment of the present disclosure. The structure of the gate driving circuit shown in FIG. 8 is basically the same as that shown in FIG. 6, the difference is that the first conductive terminal of the first switch element M1 receives a second start signal, and the first control terminal of the first switch element M1 is connected to the first conductive terminal of the first switch element M1, the third conductive terminal of the second switch element M2 receives the third clock signal CLKC, and the third control terminal of the third switch element M3 receives a second pull-down signal. In addition, the stabilization module further includes a ninth switch element M9, which is used to make the pull-up control node netAn can be better maintained at the low level in the stabilization stage.

In one embodiment, the second start signal is Gn−4 gate driving signal outputted by an (n−4)-th stage of gate driving circuit when n>4, the second pull-down signal is Gn+6 gate driving signal outputted by an (n+6)-th stage of gate driving circuit when n≤N−6. When n≥4, because the (n−4)-th stage of gate driving circuit configured to output the (n−4)-th gate driving signal is not exist, so the second start signal is a second pulse signal provided by a external circuit (not shown in the figure, please refer to FIG. 13). When n<N−6, the (n−6)-th stage of gate driving circuit configured to output the (n−6)-th gate driving signal is not exist. Therefore, the second pull-down signal is a third pulse signal provided by the external circuit.

Figure 13:
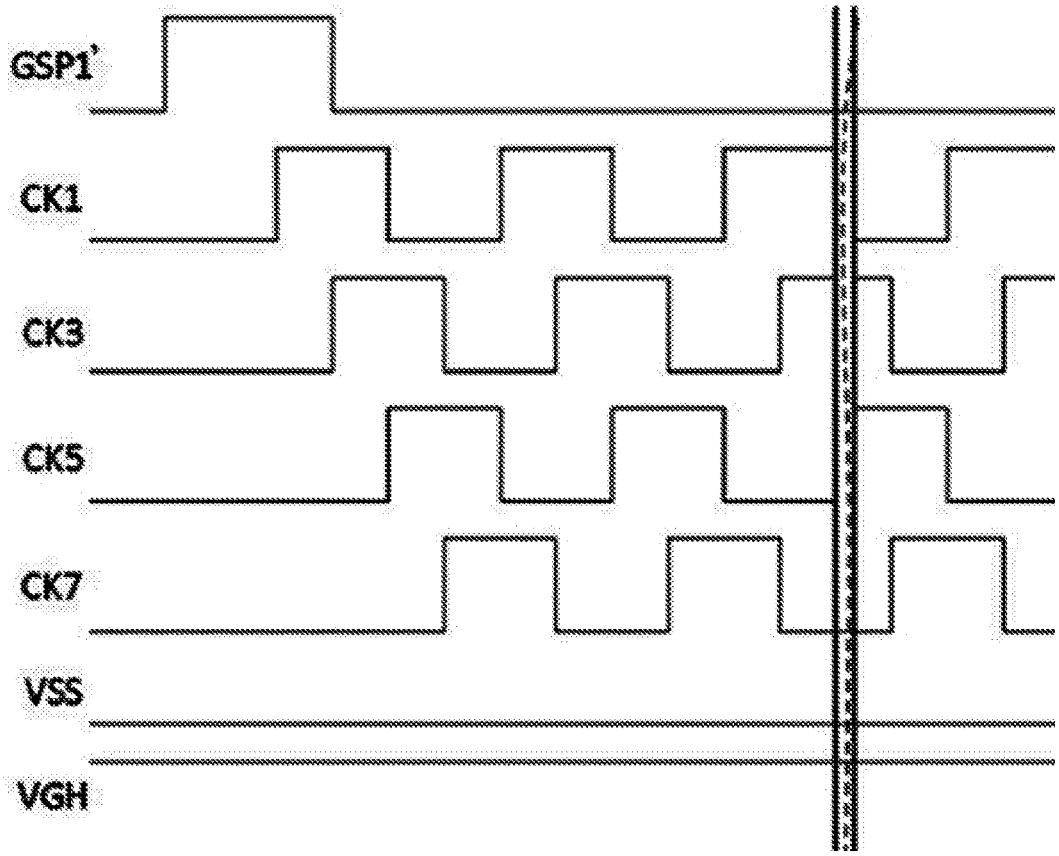
FIG. 13 is a waveform diagram of a first stage of gate driving circuit as shown in FIG. 12.

The third clock signal CLKC can be the first timing signal CLK1 as shown in FIG. 13.

In this embodiment, a seventeenth conductive terminal of the ninth switch element M9 is connected to the second conductive terminal of the first switch element M1, and the ninth control terminal of the ninth switch element M9 receives the third clock signal CLKC.

In one embodiment of the present disclosure, an eighteenth conductive terminal of the ninth switch element M9 is connected to the eleventh conductive terminal of the sixth switch element M6.

In the stabilization stage, the stabilization module of this embodiment also includes the ninth switch element M9. Because the ninth switch element M9 can be turned on when level of the third clock signal CLKC is at a high voltage level, thus the pull-up control node netAn can be better maintained at low level, so that further stabilizing the gate drive signal Gn at low level. Therefore, the gate driving circuit of this embodiment can obtain a better waveform.

A Fifth Embodiment

Figure 9:
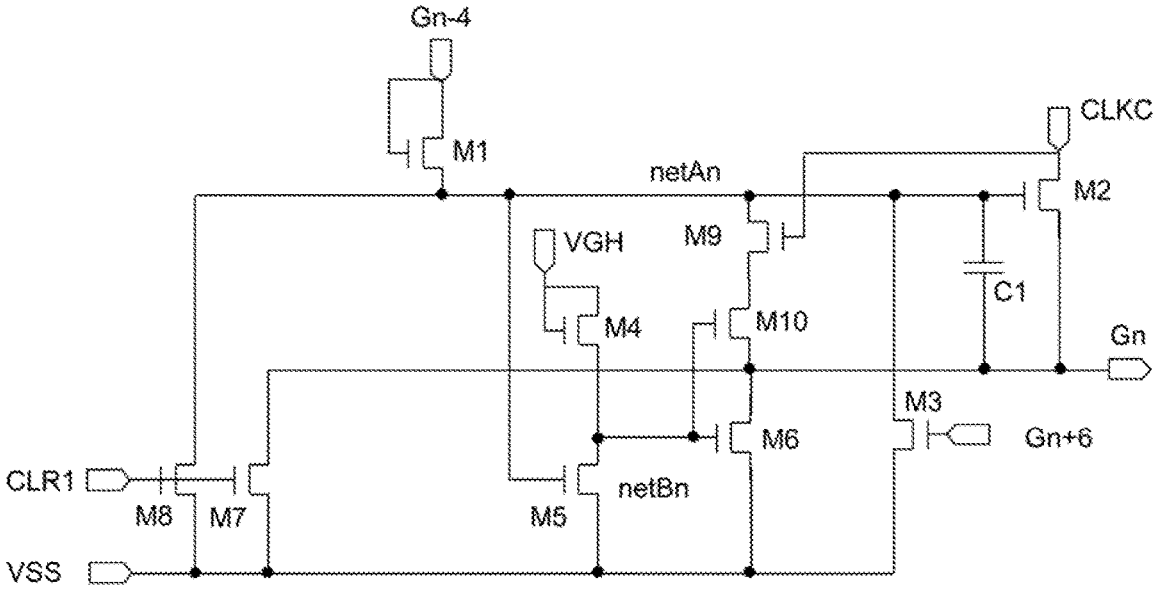
FIG. 9 is a schematic diagram of a gate driving circuit including 10T1C of a fifth embodiment of the present disclosure.

FIG. 9 is a schematic diagram of a gate driving circuit including 10T1C of the fifth embodiment of the present disclosure. The structure of the gate driving circuit shown in FIG. 9 is basically the same as that shown in FIG. 8, the difference is that the stabilization module further includes a tenth switch element M10. In addition, the eighteenth conductive terminal of the ninth switch element M9 is connected to a nineteenth conductive terminal of the tenth switch element M10, a tenth control terminal of the tenth switch element M10 is connected to the eighth conductive terminal of the fourth switch element M4, a twentieth conductive terminal of the tenth switch element M10 is connected to the fourth conductive terminal of the second switch element M2.

The stabilization module of the gate driving circuit of this embodiment also includes the tenth switch element M10, which can complementary make the pull-up control node netAn better maintained at low level, and to prevent leakage of the ninth switch element M9 from affecting the potential of the pull-up control node netAn, Therefore, the gate driving circuit in this embodiment is more stable.

A Sixth Embodiment

Figure 10:
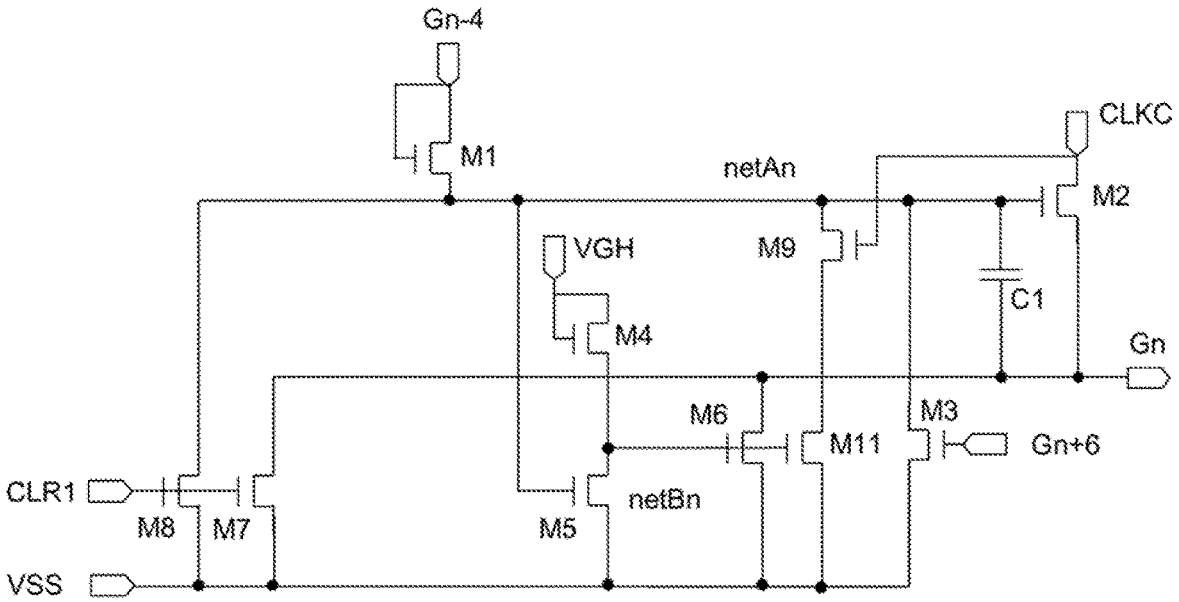
FIG. 10 is a schematic diagram of a gate driving circuit including 10T1C of a sixth embodiment of the present disclosure.

FIG. 10 is a schematic diagram of a gate driving circuit including 10T1C of the sixth embodiment of the present disclosure. The structure of the gate driving circuit shown in FIG. 10 is basically the same as that shown in FIG. 8, the difference is that the stabilization module further includes an eleventh switch element M11. In addition, the eighteenth conductive terminal of the ninth switch element M9 is connected to a twenty-first conductive terminal of the eleventh switch element M11, an eleventh control terminal of the eleventh switch element M11 is connected to the eighth conductive terminal of the fourth switch element M4, a twenty-first conductive terminal of the eleventh switch element M11 receives the reference low level voltage VSS.

The stabilization module of the gate driving circuit of this embodiment also includes the eleventh switch element M11, which can complementary make the pull-up control node netAn better maintains at low level, and to prevent leakage of the ninth switch element M9 from affecting the potential of the pull-up control node netAn. Therefore, the gate driving circuit in this embodiment is more stable.

A Seventh Embodiment

Figure 11:
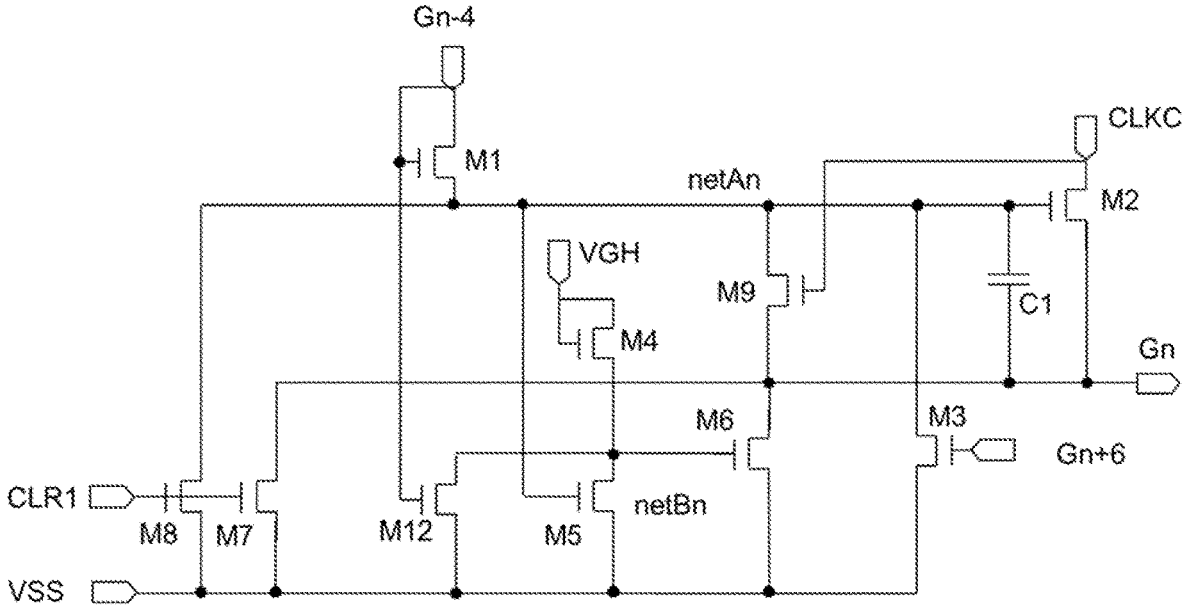
FIG. 11 is a schematic diagram of a gate driving circuit including 10T1C of a seventh embodiment of the present disclosure.

FIG. 11 is a schematic diagram of a gate driving circuit including 10T1C of the seventh embodiment of the present disclosure. The structure of the gate driving circuit shown in FIG. 11 is basically the same as that shown in FIG. 8, the difference is that the stabilization module further includes a twelfth switch element M12.

Wherein, a twenty-third conductive terminal of the twelfth switch element M12 is connected to the eighth conductive terminal of the fourth switch element M4, the twelfth control terminal of the twelfth switch element M12 receives the second start signal, a twenty-fourth conductive terminal of the twelfth switch element M12 receives the reference low level voltage VSS.

The stabilization module of the gate driving circuit of this embodiment also includes the twelfth switch element M12, wherein, the twelfth switch element M12 can complementary make the maintenance node netBn better maintained at low level, and the effect of the maintenance node netBn on the potential of the pull-up control node netAn is mitigated, so the gate driving circuit in this embodiment is more stable.

An Eighth Embodiment

Figure 12:
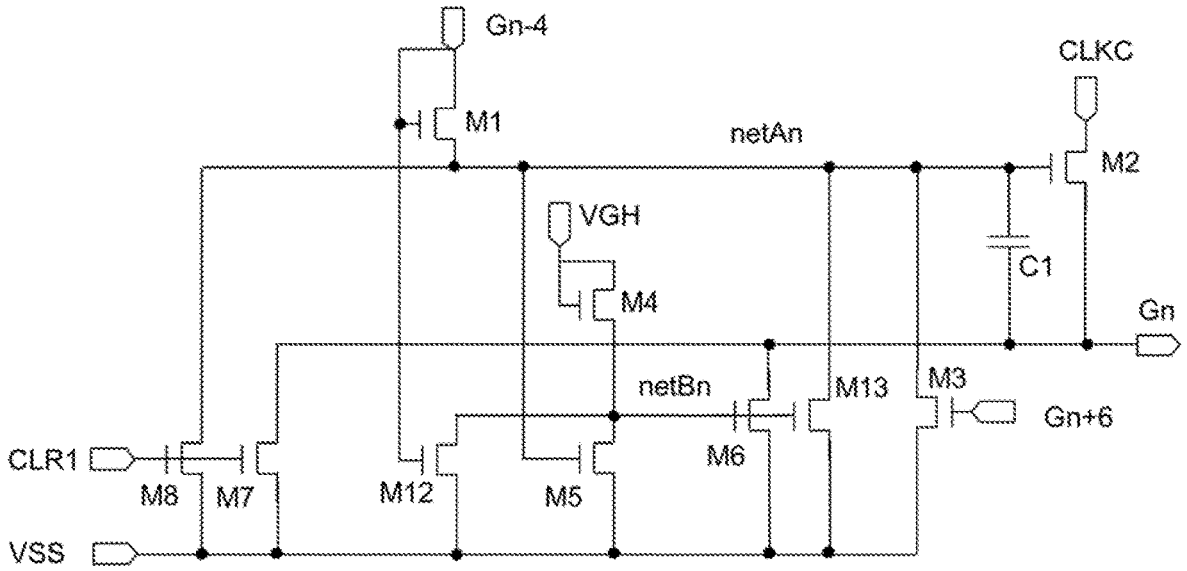
FIG. 12 is a structure diagram of a gate driving circuit including 10T1C of an eighth embodiment of the present disclosure.

FIG. 12 is a schematic diagram of a gate driving circuit including 10T1C of the eighth embodiment of the present disclosure. The structure of the gate driving circuit shown in FIG. 12 is basically the same as that shown in FIG. 8, the difference is that structure of the stabilization module is different.

Specifically, the stabilization module shown in FIG. 12 includes the fourth switch element M4, the fifth switch element M5, the sixth switch element M6, the twelfth switch element M12 and the thirteenth switch element M13. Wherein, the thirteenth switch element M13 is used to make the pull-up control node netAn maintain better at low level in the stabilization stage.

Connection relationships of the fourth switch element M4, the fifth switch element M5 and the sixth switch element M6 are shown in FIG. 8 and corresponding description.

A twenty-third conductive terminal of the twelfth switch element M12 is connected to the eighth conductive terminal of the fourth switch element M4, and a twelfth control terminal of the twelfth switch element M12 receives the second start signal, and a twenty-fourth conductive terminal of the twelfth switch element M12 receives the reference low level voltage VSS. A twenty-fifth conductive terminal of the thirteenth switch element M13 is connected to the second conductive terminal of the first switch element M1, and a thirteenth control terminal of the thirteenth switch element M13 is connected to the eighth conductive terminal of the fourth switch element M4, and a twenty-sixth conductive terminal of the thirteenth switch element M13 receives the reference low level voltage VSS.

FIG. 13 is a waveform diagram of a first stage of gate driving circuit as shown in FIG. 12. Compared to the FIG. 7, the first timing signal CK1, the second timing signal CK3, the third timing signal CK5, the fourth timing signal CK7 have not dummy-space-instruction cycle at the end of the period or the front of the period, and there is no gate driving circuit which is four stage earlier than the first gate driving circuit, so the second start signal of the first stage of gate driving circuit is the second pulse signal GSP1' shown in FIG. 13.

Wherein, the potential level of the pull-up control node netAn of this embodiment can be maintained through the maintenance node netBn and the thirteenth switch element M13, so the gate driving circuit of the present disclosure can achieve greater stability.

INDUSTRIAL APPLICABILITY

The third switch element of the gate driving circuit of the present disclosure receives the reference low level voltage to stabilize the voltage of the pull-up control node, the stabilization module consisting of the fourth switch element, the fifth switch element and the sixth switch element is configured to stabilize the voltage of the gate driving signal during a non-scanning period. The present disclosure makes it possible to achieve a simpler design, a narrower border in the display, and a gate driving circuit with greater stability.

What is claimed is:

1. A gate driving circuit configured to output a n-th gate driving signal, wherein n is a positive integer, and the gate driving circuit includes:

a first switch element, a first conductive terminal of the first switch element receiving a first start signal, a first control terminal of the first switch element receiving a first clock signal;

a second switch element, a third conductive terminal of the second switch element receiving a second clock signal, a second control terminal of the second switch element connected to a second conductive terminal of the first switch element and connected to a fourth conductive terminal of the second switch through a first capacitor;

a third switch element, a fifth conductive terminal of the third switch element connected to the second conductive terminal of the first switch element, a third control conductive terminal of the third switch element receiving a first pull-down signal, a sixth conductive terminal of the third switch element receiving reference low level voltage;

a fourth switch element, a seventh conductive terminal of the fourth switch element receiving reference high level voltage and connected to a fourth control terminal of the fourth switch element;

a fifth switch element, a ninth conductive terminal of the fifth switch element connected to an eighth conductive terminal of the fourth switch element, a fifth control terminal of the fifth switch element connected to the second conductive terminal of the first switch element, a tenth conductive terminal of the fifth switch element receiving the reference low level voltage;

a sixth switch element, an eleventh conductive terminal of the sixth switch element connected to the fourth conductive terminal of the second switch element, a sixth control terminal of the sixth switch element connected to the eighth conductive terminal of the fourth switch element, a twelfth conductive terminal of the sixth switch element receiving the reference low level voltage;

wherein the first start signal is an (n−2)-th gate driving signal outputted by an (n−2)-th stage of gate driving circuit, the first pull-down signal is a first pulse signal when n≥3; the first start signal is the first pulse signal, and the first pull-down signal is the reference low level voltage when n<3.

2. The gate driving circuit as claimed in claim 1, wherein the gate driving circuit further includes a seventh switch element, a thirteenth conductive terminal of the seventh switch element is connected to the fourth conductive terminal of the second switch element, a seventh control terminal of the seventh switch element receives a clear-reset signal, and a fourteenth conductive terminal of the seventh switch element receives the reference low level voltage.

3. The gate driving circuit as claimed in claim 1, wherein the gate driving circuit further includes an eighth switch element, a fifteenth conductive terminal of the eighth switch element is connected to the second control terminal of the second switch element, an eighth control terminal of the eighth switch element receives a clear-reset signal, and a sixteenth conductive terminal of the eighth switch element receives the reference low level voltage.

4. The gate driving circuit as claimed in claim 1, wherein the gate driving circuit further includes a twelfth switch element, a twenty-third conductive terminal of the twelfth switch element is connected to the eighth conductive terminal of the fourth switch element, and a twelfth control terminal of the twelfth switch element receives the first start signal, and a twenty-fourth conductive terminal of the twelfth switch element receives the reference low level voltage.

5. A gate driving circuit configured to output a n-th gate driving signal, wherein n≤N, n and N are positive integers, and the gate driving circuit includes:

a first switch element, a first conductive terminal of the first switch element receiving a second start signal, a first control terminal of the first switch element connected to the first conductive terminal of the first switch element;

a second switch element, a third conductive terminal of the second switch element receiving a third clock signal, a second control terminal of the second switch element connected to a second conductive terminal of the first switch element and connected to a fourth conductive terminal of the second switch through a first capacitor;

a third switch element, a fifth conductive terminal of the third switch element connected to the second conductive terminal of the first switch element, a third control terminal of the third switch element receiving a second pull-down signal, a sixth conductive terminal of the third switch element receiving reference low level voltage;

a fourth switch element, a seventh conductive terminal of the fourth switch element receiving reference high level voltage and connected to a fourth control terminal of the fourth switch element;

a fifth switch element, a ninth conductive terminal of the fifth switch element connected to an eighth conductive terminal of the fourth switch element, a fifth control terminal of the fifth switch element connected to the second conductive terminal of the first switch element, a tenth conductive terminal of the fifth switch element receiving the reference low level voltage;

a sixth switch element, an eleventh conductive terminal of the sixth switch element connected to the fourth conductive terminal of the second switch element, a sixth control terminal of the sixth switch element connected to the eighth conductive terminal of the fourth switch element, a twelfth conductive terminal of the sixth switch element receiving the reference low level voltage;

a ninth switch element, a seventeenth conductive terminal of the ninth switch element connected to the second conductive terminal of the first switch element, a ninth control terminal of the ninth switch element receiving a third clock signal, the eighteenth conductive terminal of the ninth switch element connected to the eleventh conductive terminal of the sixth switch element;

wherein the second start signal is an (n−4)-th gate driving signal outputted by an (n−4)-th stage of gate driving circuit when n>4, the second pull-down signal is an (n+6)-th gate driving signal outputted by an (n+6)-th stage of gate driving circuit when n≤N−6.

6. The gate driving circuit as claimed in claim 5, wherein the gate driving circuit further includes a seventh switch element, a thirteenth conductive terminal of the seventh switch element is connected to the fourth conductive terminal of the second switch element, a seventh control terminal of the seventh switch element receives a clear-reset signal, and a fourteenth conductive terminal of the seventh switch element receives the reference low level voltage.

7. The gate driving circuit as claimed in claim 5, wherein the gate driving circuit further includes an eighth switch element, a fifteenth conductive terminal of the eighth switch element is connected to the second control terminal of the second switch element, an eighth control terminal of the eighth switch element receives a clear-reset signal, and a sixteenth conductive terminal of the eighth switch element receives the reference low level voltage.

8. The gate driving circuit as claimed in claim 5, wherein the gate driving circuit further includes a tenth switch element, a nineteenth conductive terminal of the tenth switch element is connected to eighteenth conductive terminal of the ninth switch element, a tenth control terminal of the tenth switch element is connected to the eighth conductive terminal of the fourth element, the twentieth conductive terminal of the tenth switch element is connected to the fourth conductive terminal of the second switch element.

9. The gate driving circuit as claimed in claim 5, wherein the gate driving circuit further includes a twelfth switch element, a twenty-third conductive terminal of the twelfth switch element is connected to the eighth conductive terminal of the fourth switch element, and a twelfth control terminal of the twelfth switch element receives the second start signal, and a twenty-fourth conductive terminal of the twelfth switch element receives the reference low level voltage.

10. A gate driving circuit configured to output a n-th gate driving signal, wherein n≤N, n and N are positive integers, and the gate driving circuit includes:

a first switch element, a first conductive terminal of the first switch element receiving a second start signal, a first control terminal of the first switch element connected to the first conductive terminal of the first switch element;

a second switch element, a third conductive terminal of the second switch element receiving a third clock signal, a second control terminal of the second switch element connected to a second conductive terminal of the first switch element and connected to a fourth conductive terminal of the second switch through a first capacitor;

a third switch element, a fifth conductive terminal of the third switch element connected to the second conductive terminal of the first switch element, a third control terminal of the third switch element receiving a second pull-down signal, a sixth conductive terminal of the third switch element receiving reference low level voltage;

a fourth switch element, a seventh conductive terminal of the fourth switch element receiving reference high level voltage and connected to a fourth control terminal of the fourth switch element;

a fifth switch element, a ninth conductive terminal of the fifth switch element connected to an eighth conductive terminal of the fourth switch element, a fifth control terminal of the fifth switch element connected to the second conductive terminal of the first switch element, a tenth conductive terminal of the fifth switch element receiving the reference low level voltage;

a sixth switch element, an eleventh conductive terminal of the sixth switch element connected to the fourth conductive terminal of the second switch element, a sixth control terminal of the sixth switch element connected to the eighth conductive terminal of the fourth switch element, a twelfth conductive terminal of the sixth switch element receiving the reference low level voltage;

a thirteenth switch element, a twenty-fifth conductive terminal of the thirteenth switch element connected to a second conductive terminal of the first switch element, and a thirteenth control terminal of the thirteenth switch element connected to the eighth conductive terminal of the fourth switch element, and a twenty-sixth conductive terminal of the thirteenth switch element receiving the reference low level voltage;

wherein the second start signal is an (n−4)-th gate driving signal outputted by an (n−4)-th stage of gate driving circuit when n>4, the second pull-down signal is an (n+6)-th gate driving signal outputted by an (n+6)-th stage of gate driving circuit when n≤N−6.

11. The gate driving circuit as claimed in claim 10, wherein the gate driving circuit further includes a seventh switch element, a thirteenth conductive terminal of the seventh switch element is connected to the fourth conductive terminal of the second switch element, a seventh control terminal of the seventh switch element receives a clear-reset signal, and a fourteenth conductive terminal of the seventh switch element receives the reference low level voltage.

12. The gate driving circuit as claimed in claim 10, wherein the gate driving circuit further includes an eighth switch element, a fifteenth conductive terminal of the eighth switch element is connected to the second control terminal of the second switch element, an eighth control terminal of the eighth switch element receives a clear-reset signal, and a sixteenth conductive terminal of the eighth switch element receives the reference low level voltage.

13. The gate driving circuit as claimed in claim 10, wherein the gate driving circuit further includes a twelfth switch element, a twenty-third conductive terminal of the twelfth switch element is connected to the eighth conductive terminal of the fourth switch element, and a twelfth control terminal of the twelfth switch element receives the second start signal, and a twenty-fourth conductive terminal of the twelfth switch element receives the reference low level voltage.

* * * * *